US007253406B1

(12) United States Patent
Sheehan et al.

(10) Patent No.: US 7,253,406 B1
(45) Date of Patent: Aug. 7, 2007

(54) REMOTE REAGENT CHEMICAL IONIZATION SOURCE

(75) Inventors: Edward W Sheehan, Pittsburgh, PA (US); Ross C Willoughby, Pittsburgh, PA (US)

(73) Assignee: Chem-Space Associates, Incorporated, Pittsburgh, PA (US)

( * ) Notice: Subject to any disclaimer, the term of this patent is extended or adjusted under 35 U.S.C. 154(b) by 0 days.

(21) Appl. No.: 11/491,634

(22) Filed: Jul. 24, 2006

Related U.S. Application Data

(63) Continuation of application No. 11/120,363, filed on May 2, 2005, now Pat. No. 7,095,019, which is a continuation of application No. 10/449,344, filed on May 30, 2003, now Pat. No. 6,888,132.

(60) Provisional application No. 60/384,864, filed on Jun. 1, 2002.

(51) Int. Cl.
*H01J 49/00* (2006.01)

(52) U.S. Cl. ..... 250/288; 250/282; 250/286

(58) Field of Classification Search ..... None
See application file for complete search history.

(56) References Cited

U.S. PATENT DOCUMENTS 5,961,772 A 10/1999 Selwyn 6,228,330 B1 5/2001 Herrmann et al.

OTHER PUBLICATIONS

Cody,R.B., et al., "Versatile new ion source for the analysis of materials in open air under ambient conditions", Anal Chem 77, pp. 2297-2302 (2005).

McEwen, C.N., et al., "Analysis of solids, liquids, and biological tissues using solids probe introduction at atmostpheric pressure . . . ", Anal Chem 77, pp. 7826-7831 (2005)..

*Primary Examiner*—Jack I. Berman
*Assistant Examiner*—Zia R. Hashmi

(57) ABSTRACT

An improved ion source for collecting and focusing dispersed gas-phase ions from a reagent source at sub-atmospheric or intermediate pressure, having a remote source of reagent ions separated from a low-field sample ionization region by a barrier, comprised of alternating laminates of metal and insulator, populated with a plurality of openings, wherein DC potentials are applied to each metal laminate necessary for transferring reagent ions from the remote source into the low-field sample ionization region where the reagent ions react with neutral and/or ionic sample forming ionic species. The resulting ionic species are then introduced into the vacuum system of a mass spectrometer or ion mobility spectrometer. Embodiments of this invention are methods and devices for improving sensitivity of mass spectrometry when gas and liquid chromatographic separation techniques are coupled to sub-atmospheric and intermediate pressure photo-ionization, chemical ionization, and thermal-pneumatic ionization sources.

23 Claims, 3 Drawing Sheets

REMOTE REAGENT CHEMICAL IONIZATION SOURCE

CROSS-REFERENCE TO RELATED APPLICATIONS

This is a continuation of application Ser. No. 11/120,363, filed May 2, 2005, now U.S. Pat. No. 7,095,019, granted Aug. 22, 2006; which is a continuation of application Ser. No. 10/449,344, filed May 30, 2003, now U.S. Pat. No. 6,888,132, granted May 3, 2005. This application claims the benefit of Provisional Patent Application Ser. No. 60/384,864, filed Jun. 1, 2002. This application is related to Provisional Application Ser. No. 60/210,877, filed Jun. 9, 2000, now application Ser. No. 09/877,167, filed Jun. 8, 2001; and Provisional Patent Application 60/384,869, filed Jun. 1, 2002, now application Ser. No. 10/449,147, filed May 31, 2003.

GOVERNMENT SUPPORT

The invention described herein was made in the course of work under a grant from the Department of Health and Human Services, Grant Number: 1 R43 RR143396-1.

BACKGROUND

1. Field of Invention

This invention relates to methods and devices for improved ionization, collection and focusing of ions generated from chemical and photo-ionization for introduction into the mass spectrometer and other gas-phase ion analyzers and detectors.

2. Description of Prior Art

The generation of ions at or near atmospheric pressure is accomplished by a variety of means; including, electrospray (ES), atmospheric pressure chemical ionization (APCI), atmospheric pressure matrix assisted laser desorption ionization (AP-MALDI), discharge ionization, $^{63}$Ni sources, inductively coupled plasma ionization, and photoionization. A general characteristic of these atmospheric or near atmospheric ionization sources is the dispersive nature of the ions once produced. Needle sources such as electrospray and APCI disperse ions radially from the axis in high electric fields emanating from needle tips. Aerosol techniques disperse ions in the radial flow of gases emanating from tubes and nebulizers. Even desorption techniques such as atmospheric pressure MALDI will disperse ions in a solid angle from a surface. The radial cross-section of many dispersive sources can be as large as 5 or 10 centimeters in diameter.

As a consequence of a wide variety of dispersive processes, efficient sampling of ions from atmospheric pressure sources to small cross-sectional targets or through small cross-sectional apertures and tubes (usually less than 1 mm) into a mass spectrometer becomes quite problematic. This is particularly amplified if the source on ions is removed from the regions directly adjacent to the aperture.

The simplest approach to sampling dispersive atmospheric sources is to position the source on axis with a sampling aperture or tube. The sampling efficiency of simple plate apertures is generally less than 1 ion in $10^4$. Devices developed by Fite (U.S. Pat. No. 4,209,696) used pinhole apertures in plates with electrospray. Devices developed by Laiko and Burlingame (W.O. Pat. No. 99163576 and U.S. Pat. No. 5,965,884) used aperture plates with atmospheric pressure MALDI. An atmospheric pressure source by Kazuaki et al (Japan Pat. No. 04215329) is also representative of this inefficient approach. This general approach in severely restricted by the need for precise aperture alignment and source positioning, for example, in the case of an APCI source the position of the discharge needle; and very poor sampling efficiencies.

Recently, a photoionization sources have been developed for LC/MS applications by Robb and coworkers (W.O. No. 01/33605 A2 and U.S. Pat. No. 6,534,765). The use of low field photo-ionization sources has lead to some improvement in sampling efficiency from atmospheric pressure sources, but these sources also suffer from a lower concentration of reagent ions when compared to traditional APCI sources.

A wide variety of source configurations utilize conical skimmer apertures in order to improve collection efficiency over planar devices. This approach to focusing ions from atmospheric sources is limited by the acceptance angle of the electrostatic fields generated at the cone. Generally, source position relative to the cone is also critical to performance, although somewhat better than planar apertures. Conical apertures are the primary inlet geometry for commercial ICP/MS with closely coupled and axially aligned torches. Examples of conical-shaped apertures are prevalent in ES and APCI (U.S. Pat. No. 5,756,994), and ICP (U.S. Pat. No. 4,999,492) inlets. As with planar apertures, source positioning relative to the aperture is also critical to performance; and collection efficiency is quite low.

Another focusing alternative utilizes a plate lens with a large hole in front of an aperture plate or tube for transferring sample into the vacuum system. The aperture plate is generally held at a high potential difference relative to the plate lens. The configuration creates a potential well that penetrates into the source region and has a significant improvement in collection efficiency relative to the plate or cone apertures. But, this configuration has a clear disadvantage in that the potential well resulting from the field penetration is not independent of ion source position, or potential. High voltage needles can diminish this well. Off-axis sources can affect the shape and collection efficiency of the well also. Optimal positions are highly dependent upon both flow (liquid and, concurrent and countercurrent gas flows) and voltages. They are reasonable well suited for small volume sources such as nanospray while larger flow sources become less efficient and problematic. Because this geometry is generally preferential over plates and cones, it is seen in most types of atmospheric source designs. We will call this approach the "Plate-Well" design which is reported with apertures by Labowsky et al. (U.S. Pat. No. 4,531,056), Covey et al. (U.S. Pat. No. 5,412,209) and Franzen (U.S. Pat. No. 5,747,799). There are also many Plate-Well designs with tubes reported by Fenn et al. (U.S. Pat. No. 4,542,293), Goodley et al. (U.S. Pat. No. 5,559,326), and Whitehouse et al. (U.S. Pat. No. 6,060,705).

Several embodiments of atmospheric pressure sources have incorporated grids in order to control the sampling of gas-phase ions. Jarrell and Tomany (U.S. Pat. No. 5,436,446) utilized a grid that reflected lower mass ions into a collection cone and passed large particles through the grid. This modulated system was intended to allow grounded needles and collection cones or apertures, and float the grid at high alternating potentials. This device had limitations with duty cycle of ion collection in a modulating field (non-continuous sample introduction) and spacial and positioning restrictions relative to the sampling aperture. Andrien et al (U.S. Pat. No. 6,207,954 B1) used grids as counter electrodes for multiple corona discharge sources configured in geometries and at potentials to generated ions of opposite charge and monitor their interactions and reactions. This specialized reaction source was not configured with high field ratios across the grids and was not intended for high transmission and collection, rather for generation of very specific reactant ions. An alternative atmospheric pressure device by Yoshiaki (JP10088798) utilized on-axis hemispherical grids in the second stage of pressure reduction. Although the approach is similar to the present device in concept, it is severely limited by gas discharge that may occur at these low pressures if higher voltages are applied to the electrodes and the fact that most of the ions (>99%) formed at atmospheric pressure are lost at the cone-aperture from atmospheric pressure into the first pumping stage.

Grids are also commonly utilized for sampling ions from atmospheric ion sources utilized in ion mobility spectrometry (IMS). Generally, for IMS analysis ions are pulsed through grids down a drift tube to a detector as shown in Kunz (U.S. Pat. No. 6,239,428B1). Great effort is made to create a planar plug of ions in order to maximize resolution of components in the mobility spectrum. These devices generally are not continuous, nor do they require focusing at extremely high compression ratios.

SUMMARY

A preferred embodiment of the invention is the configuration of a high efficiency ionization source utilizing remote reagent ion generation coupled with a large reaction volume electro-optical well to facilitate efficient sample ionization and collection. The novelty of this device is the manner of isolation of the electric fields in the reagent ion generation region from the electric fields of the reaction or sample ionization region and the product ion-sampling region or funnel region. This is accomplished through the utilization of a perforated and laminated surface that efficiently passes reagent ions from the reagent source region to the reaction region without significant penetration of the fields from the adjacent regions.

OBJECTS AND ADVANTAGES

One object of the present invention is to increase the collection efficiency of ions and/or charged particles at a collector, or through an aperture or tube into a vacuum system, by creating a very small cross-sectional area beam of ions and/or charged particles from highly dispersed atmospheric pressure ion sources. The present invention has a significant advantage over prior art in that the use of a Laminated High Transmission Element (L-HTE) to separate reagent ion generation from product ion formation and ion focusing allows precise shaping of fields in both regions. Ions can be generated in large ion source regions without losses to walls. Droplets have longer time to evaporate and/or desorb neutrals or ions without loss from the sampling stream. Source temperatures can be lower because rapid evaporation is not required. This can prevent thermal decomposition of some labile compounds. Counter electrodes for APCI needles do not have to be the plate lens as practices with most conventional sources or even the HTE (high transmission element, as described by Sheehan et al., U.S. patent application Ser. No. 09/877,167). The aerosol and plasma can be generated remotely and ions can be allowed to drift toward the HTE.

Another object of the present invention is to have collection efficiency be independent of ion source position. With the present invention there is no need for precise mechanical needle alignment or positioning relative to collectors, apertures, or tubes invention. Ions generated at any position in the reaction and product ion-sampling regions are transmitted to the collector, aperture, or tube with similar efficiency. No existing technology has positional and potential independence of the source. The precise and constant geometry, and alignment of the focusing well with sampling apertures will not change with needle placement. The electrostatic fields inside the reaction, product ion-sampling, and deep-well regions (focusing side) will not change, even if they change outside (reagent ion source side).

Another object of the present invention is the independence of ion source type. This device is capable of transmission and collection of ions from any atmospheric (or near atmospheric) pressure ionization source; including, atmospheric pressure chemical ionization, inductively coupled plasma, discharge sources, $Ni^{63}$ sources, spray ionization sources, induction ionization sources and photoionization sources. The device is also capable of sampling ions of only one polarity at a time, but with extremely high efficiency.

Another object of the present invention is to efficiently collect and/or divert a flow of ions from more than one source. This can be performed in a simultaneous fashion for introduction of mass calibrants from a separate source and analytes from a different source at a different potential; conversely, it can be performed sequentially as is typical with multiplexing of multiple chromatographic streams introduced into one mass spectrometer.

Another object of the present invention is to efficiently transmit ions to more than one target position. This would have the utility of allowing part of the sample to be collected on a surface while another part of the sample is being introduced through an aperture into a mass spectrometer to be analyzed.

Another object of the present invention is to improve the efficiency of multiplexed inlets from both multiple macroscopic sources and micro-chip arrays, particularly those developed with multiple needle arrays for APCI. Position independence of this invention make it compatible with a wide variety of needle array technologies.

Another object of the present invention is to remove larger droplets and particles from aerosol sources with a counterflow of gas to prevent contamination of deep-well lens, funnel aperture wall, apertures, inlets to tubes, vacuum components, etc.

One major advantage of the present device is the capability of generating a large excess of reagent ions in a remote region and then introducing the reagent ions into the reaction region to drive the equilibrium of the reaction far toward completion.

Another advantage of the present invention is the lack of limitations to the reaction volume. The reaction volume could literally be 100's of $cm^3$, not incurring sampling losses associated with conventional sources.

Another advantage of this source is the ability for neutrals and reagent ions to reside in the reaction region, in the presence of low electrostatic fields, for relatively long durations [even in the large volume]; allowing even reactions with very slow reaction kinetics to proceed toward completion.

Another advantage of the present device is the ability to utilize the tremendous compression capabilities of funnel-well optics to compress all ions generated in the reaction and funnel regions into a small cross-sectional area.

One of the most important advantages of the remote reagent ion source when compared to convention APCI sources is the lack of recombination losses, from, for example, stray electrons; with the extraction of reagent of one polarity ions out of a plasma and transport into the reaction region. In this device there are not recombination losses in the reaction region.

DRAWING FIGURES

REFERENCE NUMBERS IN DRAWINGS

| | |
|---|---|
| 10 | sample source |
| 12 | sample delivery means or line |
| 14 | nebulizer |
| 20 | nebulization gas source |
| 30 | nebulizer heating supply |
| 32 | heating coils |
| 34 | sample aerosol flow |
| 36 | ion source entrance wall |
| 40 | reagent ion generation region |
| 41 | high voltage supply |
| 42 | discharge needle |
| 44 | reagent ion source region |
| 45 | lamp |
| 46 | reagent ion trajectories |
| 48 | reagent gas source |
| 50 | product ion-sampling or funnel region |
| 52 | reaction or sample ionization region |
| 54 | equipotential lines |
| 56 | sample ion trajectories |
| 58 | funnel aperture |
| 60 | exhaust outlet |
| 62 | exhaust destination |
| 64 | inner high transmission electrode |
| 66 | outer high transmission electrode |
| 70 | deep-well region |
| 72 | deep-well lens |
| 74 | deep-well insulator ring |
| 76 | exit aperture |
| 78 | funnel aperture wall |
| 80 | ion collection region |

DESCRIPTION

Figure 1:
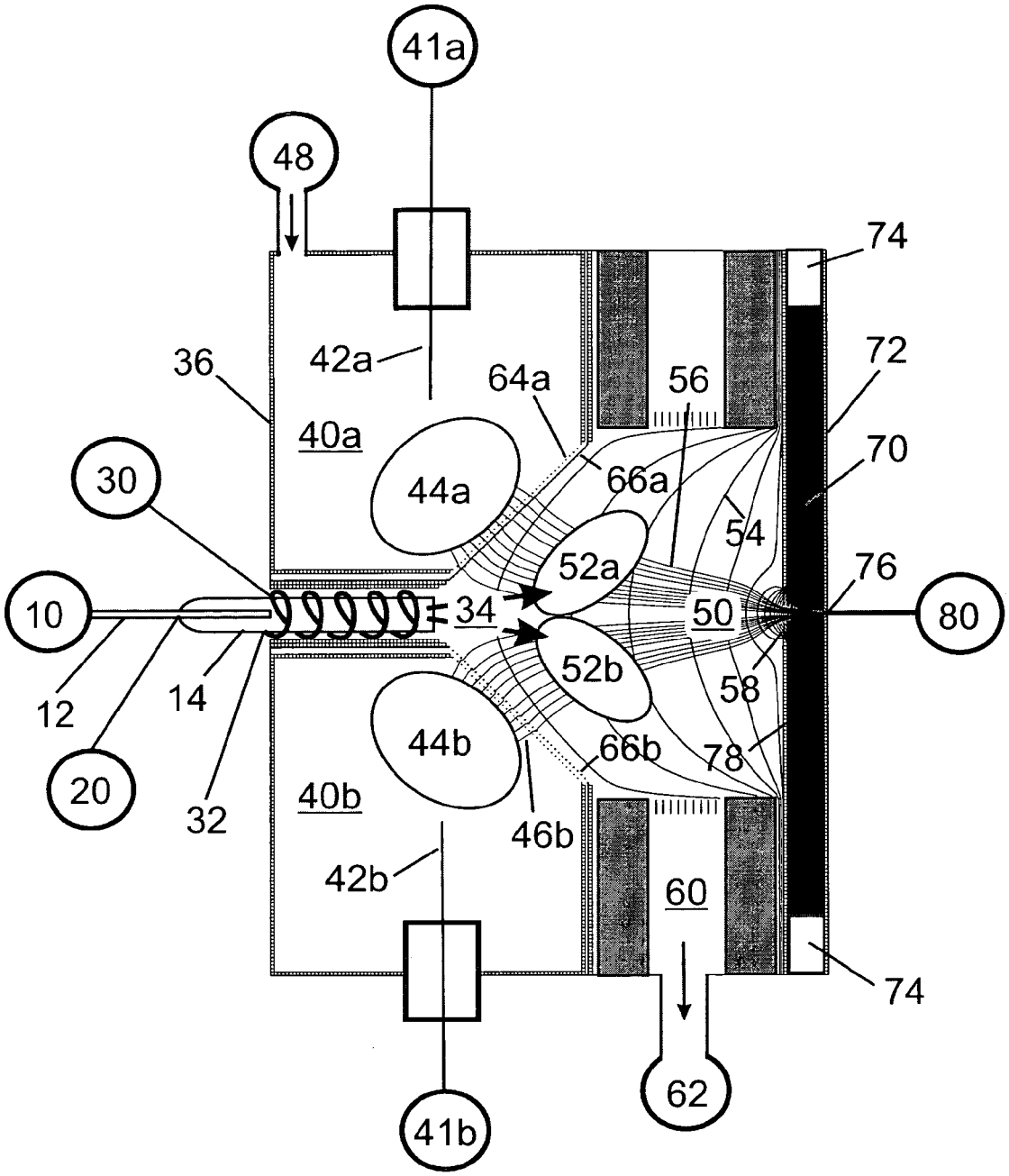
FIG. 1 is a cross-sectional illustration of a remote reagent ion generation source for atmospheric pressure chemical ionization (APCI).

Preferred Embodiment—FIG. 1 (Remote Atmospheric Pressure Chemical Ionization, Remote-APCI)

A preferred embodiment of the chemical ionization source of the present invention at atmospheric pressure is illustrated in FIG. 1. Sample from a sample source 10 is delivered to a nebulizer 14 by a sample delivery means 12 through an ion source entrance wall 36. This embodiment contains a heated nebulizer for nebulization and evaporation of sample streams emanating from liquid chromatographs and other liquid sample introduction devices. The liquid sample is heated, nebulized, and vaporized by the input of nebulization gas from a nebulization gas source 20 and by heat from heating coils 32 generated from a nebulizer heating supply 30. The nebulizer generates a sample aerosol flow 34 with the sample being vaporized into the gas-phase and proceeding into a reaction or sample ionization region 52.

Reagent ions are generated in a reagent ion generation region 40 by electron ionization from a discharge needle 42. The voltage applied to the discharge needle is supplied from a high voltage supply 41. Reagent gas is supplied to region 40 from a reagent gas source 48. In this preferred embodiment, reagent ions are generated in more than one region in the annular space around the sample ionization regions 52*a* and 52*b*; these multiple regions are designated 40*a* and 40*b*. Each region 40*a*, 40*b* has an associated discharge needle 42*a*, 42*b*, respectively.

With DC potentials applied to the discharge needle 42*a*, 42*b*; a planar laminated high-transmission element (as described in our patent, U.S. patent application Ser. No. 10/449,147) consisting of an inner high-transmission electrode or just inner-HT electrode 64*a*, 64*b* and an outer high-transmission electrode or just outer-HT electrode 66*a*, 66*b* populated with slotted openings (not shown); a funnel aperture wall 78; and a deep-well lens 72. Approximately all of the reagent ions generated in a reagent ion source region 44*a*, 44*b* take on a series of reagent ion trajectories 46*a*, 46*b* as they flow from regions 40*a*, 40*b*, through the inner-64*a*, 64*b* and outer-HT electrodes 66*a*, 66*b* and into the product ion-sampling or funnel region 50; where the reagent ions undergo ion-molecule reactions with the sample, delivered to region 50 from source 10, to make gas-phase sample ions in sample ionization region 52*a*, 52*b*.

Under the influences of the applied DC potentials on the elements, walls, and lenses; approximately all of the gas-phase ions in region 50, including reagent and sample ions, take on a series of ions trajectories 56 and are focused through the funnel aperture 58 in the funnel aperture wall 78, into a deep-well region 70 through an exit aperture 76 in the deep-well lens 72 into the ion collection region 80. The deep-well lens 72 is isolated from the funnel aperture wall 78 by a deep-well insulator ring 74.

Aperture 76 has a diameter appropriate to restrict the flow of gas into region 80. In the case of vacuum detection, such as mass spectrometry in region 80, typical aperture diameters are 100 to 1000 micrometers. The collection region 80 in this embodiment is intended to be the vacuum system of a mass spectrometer (interface stages, optics, analyzer, detector) or other low-pressure ion and particle detectors.

Excess sample and reagent gases in region 50 are exhausted through a exhaust outlet 60 and delivered to an exhaust destination 62.

Figure 2:
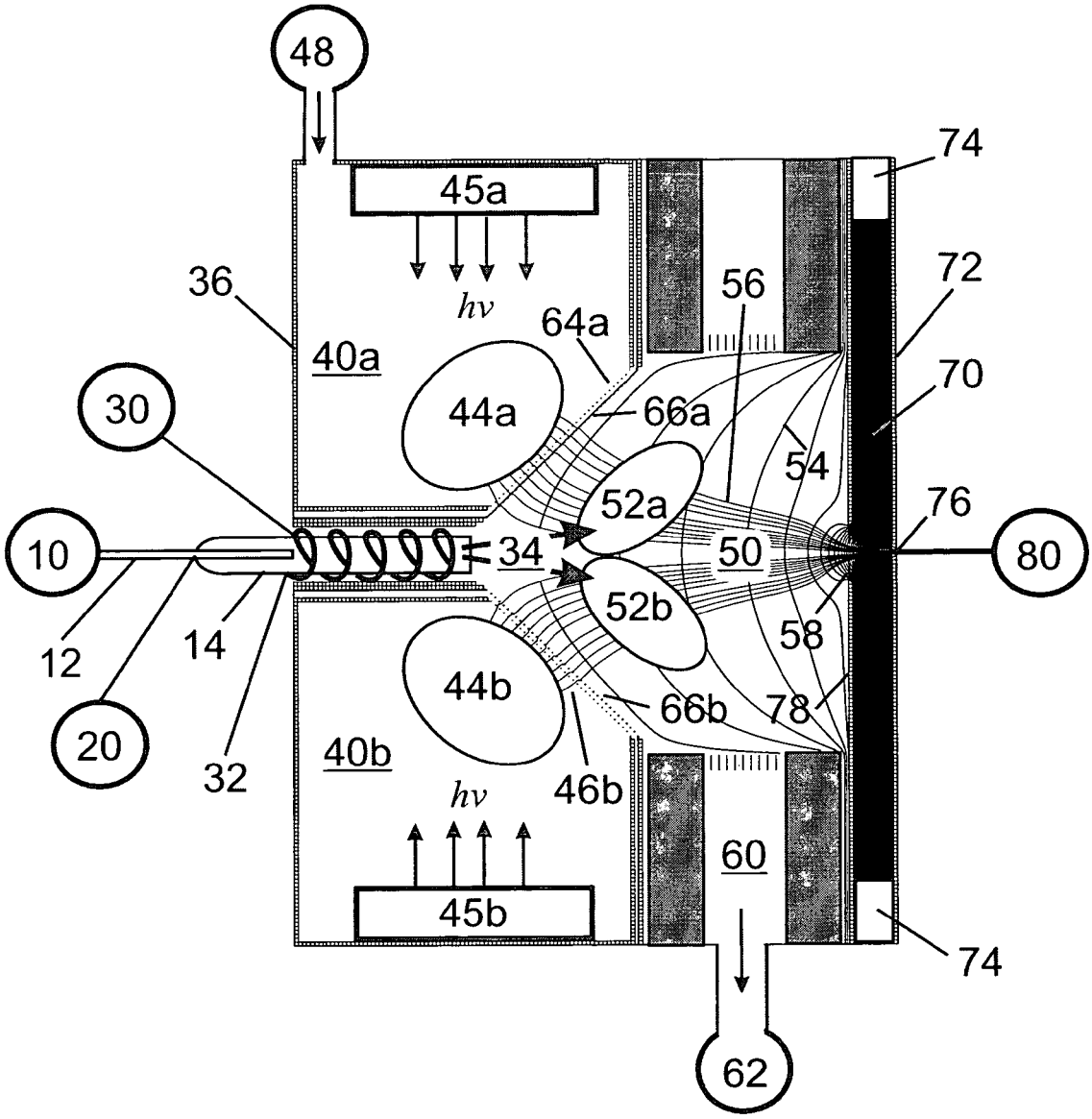
FIG. 2 is a cross-sectional illustration of a remote reagent ion generation source for atmospheric pressure photo-ionization (APPI).

Additional Embodiment—FIG. 2 (Remote Atmospheric Pressure Photo-Ionization, Remote-APPI)

An additional embodiment is shown in FIG. 2; an atmospheric pressure chemical ionization source where photo-ionization is used to generate reagent ions. The only distinguishing component of this embodiment that varies from the previous embodiment shown in FIG. 1 is that the high voltage supply 41 and discharge needle 42 are replaced by a lamp 45 to supply photons required to facilitate photo-ionization in regions 40*a*, 40*b*. In this case, multiple lamps 45*a*, 45*b* are used to create photo-reagent ions in multiple source regions 44*a*, 44*b* located in the annular space around the sample ionization region 52*a*, 52*b*. Organic dopants, such as but limited to benzene, toluene, or acetone can be added to the reagent ionization region 40*a*, 40*b* from source 48 along with any other gases from source 48.

Figure 3:
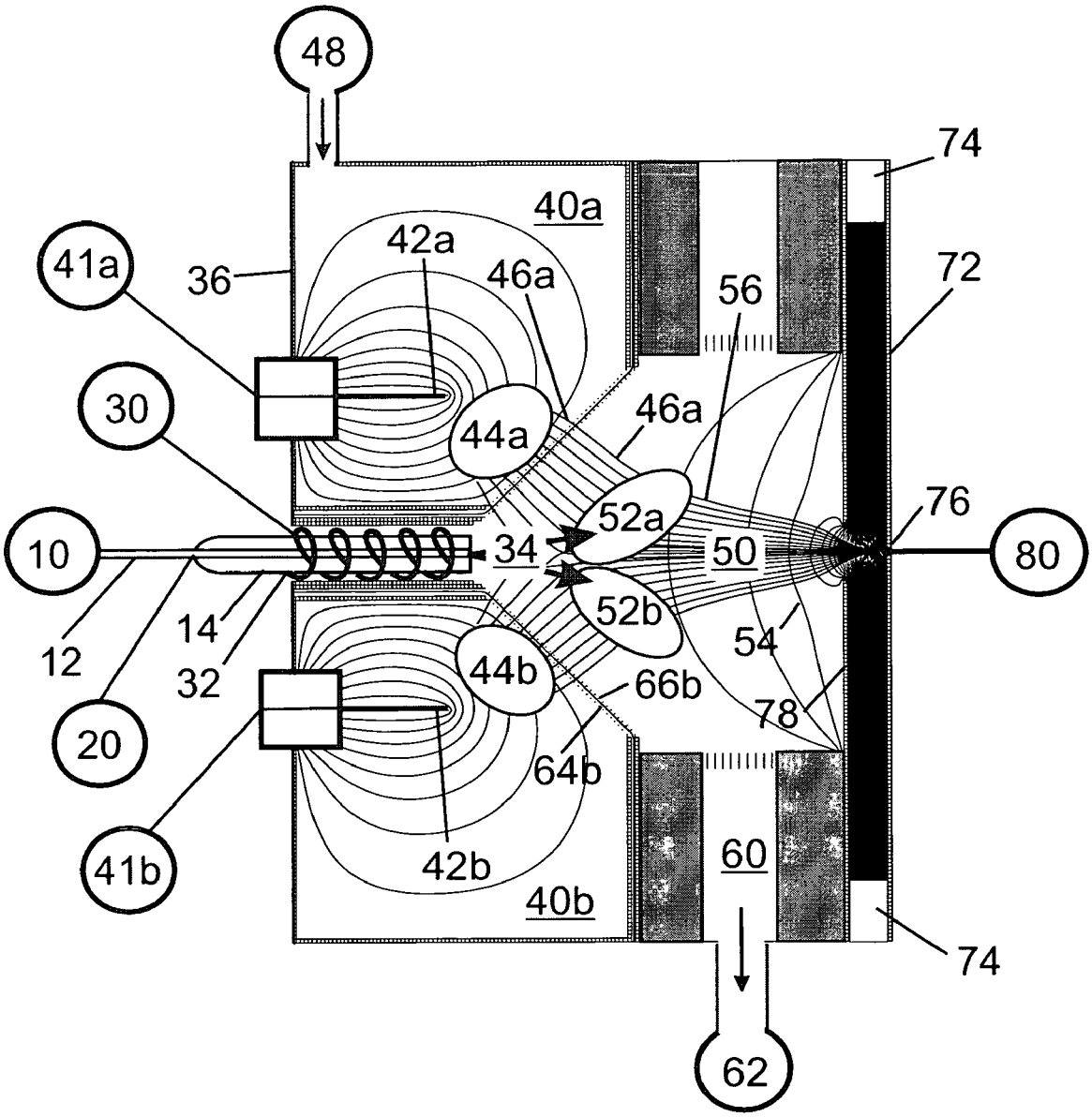
FIG. 3 is a cross-sectional illustration of a remote reagent ion generation source for a lower-pressure chemical ionization (CI) source.

Alternative Embodiment—FIG. 3 (Chemical Ionization and Thermospray)

There are various possibilities with regard to the type of sample and pressure regime at which the chemical ionization source is operated, as illustrated in FIG. 3. FIG. 3 shows a source, at atmospheric or less than atmospheric pressure, with the sample being delivered through the sample delivery line 12 is a gas, where the sample source 10 is a gas chromatograph, or is a liquid and the nebulizer 14 is a thermospray nebulizer where the sample source is a liquid chromatograph. Gases in the reaction region 50 are removed by a mechanical pump in gas destination 62 to maintain the reaction region at atmospheric or lower pressures.

Operation—FIGS 1, 2, 3

The manner of using the source to ionize gas-phase molecular species is similar to that for sources in present use. Namely, gas-phase reagent ions are generated in a region 40 adjacent to the sample ionization region 52, by means of a corona discharge, such as but not limited to atmospheric pressure ionization, atmospheric pressure chemical ionization, etc. Alternatively, reagent ions can also be formed by the process of photoionization, whereby the gas or gases in the reagent ion generation region 40 undergoes photoionization by light emitted from the lamp 45. Reagent ions in the region 44 are attracted to the laminated element (64, 66) by an electric potential difference between the source region 40 and the potential of the inner-HT electrode 64. The reagent ions moving toward the inner-HT electrode are diverted away from the conducting surface of electrode 64 and focused into the openings in the laminated high-transmission electrode (64, 65) due to the field lines emanating from the outer-HT electrode 66 through the openings into the reagent ion source region 44 causing approximately all of the ions to flow through the openings and out into the sample ionization region 52 as shown by the ion trajectories 46. The degree to which the field penetrates into region 44 is due to the potential difference between the inner- and outer-HT electrode 64, 66, respectively, being relatively high.

The sample, composed of neutral or ionic aerosols or both, is introduced into the reaction region 52 where the components of the sample interact with the reagent ions moving through this region, forming ionic species from the sample components. New ionic species formed from the interaction of reagent ions and sample aerosol and any other remaining ionic species in regions 50, 52 are accelerated away from the funnel region 50 and focused through the funnel aperture 58 into the deep-well region 70 where a well collimated and highly compressed beam of ions is delivered to the exit aperture 76 for transfer into the ion collection region 80 where the collection region is the vacuum system of a mass spectrometer or any other low-pressure ion or particle detector.

Gases from the reagent ion generation region 40 that have passed through the laminated high-transmission element and gases from the sample source 10 that have flowed into region 50 are at least partially removed from the funnel region through the exhaust outlet 60.

FIG. 3 shows a source where the sample is introduced by spraying a liquid by means of a thermospray nebulizer or alternatively a gas from a gas chromatograph. A mechanical vacuum pump in the exhaust destination 62 maintains the pressure in the reaction region 50 to as low as 100 millitorr. In this pressure regime (typically in the 10 torr range) care must be taken to avoid discharge from occurring in region 50.

CONCLUSION RAMIFICATIONS, AND SCOPE

Although the description above contains many specifications, these should not be construed as limiting the scope of the invention but as merely providing illustrations of some of the presently preferred embodiments of this invention. For example the sample can be introduced off-axis or orthogonal to the funnel region; the laminated high-transmission element can have other shapes; the number of laminates of the laminated high-transmission element can vary depending on the source of ions, the type of ion-collection region or a combination of both, etc.

Thus the scope of the invention should be determined by the appended claims and their legal equivalents, rather than by the examples given.

We claim:

1. A remote reagent apparatus operated substantially below atmospheric pressure for the production of gas-phase sample ions, excited sample ions, charged particles, or product ionic species thereof produced from sample species, the apparatus comprising:

a. a remote ion source region producing reactant species remotely from a sample reaction region;

b. said sample reaction region receiving the outlet of said ion source region, said reactant species reacting with said sample species in said reaction region; and c. a perforated electrically conductive barrier, wherein said barrier is located between said ion source and reaction regions; through which the said reactant species travel from said ion source region to said reaction region, whereby said gas-phase sample ions, excited ions, charged particles, or product ionic species thereof are collected or analyzed.

2. A remote reagent apparatus operated substantially below atmospheric pressure for the production of gas-phase sample ions, excited sample ions, charged particles, or product ionic species thereof produced from sample species, as defined in claim 1, wherein said remote ion source region is comprised of one or more remote direct current or alternating current discharge, photoionization, electron emitting source, chemical ionization, sputtering or desorption source, gas discharge in a magnetic field, or combination thereof; said ionization region positioned relative to said sample reaction region, each of said multiple ion source regions being separated from said sample reaction region by one or more said perforated electrically conducting barriers, whereby said individual barriers may permit selective special or temporal transmission from one or more said ion sources.

3. A remote reagent apparatus operated substantially below atmospheric pressure for the production of gas-phase sample ions, excited sample ions, charged particles, or product ionic species thereof produced from sample species, as defined in claim 1, wherein said remote ion source region is supplied with a specific reagent gas or gases to facilitate production of said reactant species that yield desired or predictable said sample ions, excited sample ions, charged particle, or product ionic species in said sample reaction source region.

4. A remote reagent apparatus operated substantially below atmospheric pressure for the production of gas-phase sample ions, excited sample ions, charged particles, or product ionic species thereof produced from sample species, as defined in claim 1, wherein said perforated electrically conductive barrier is comprised of a perforated surface such as a perforated metal, a perforated metal with a plurality of holes or openings, a perforated laminated structure comprised of metal and insulating laminates, or a perforated laminated structure comprised of metal and insulting laminates with a plurality of holes.

5. A remote reagent apparatus operated substantially below atmospheric pressure for the production of gas-phase sample ions, excited sample ions, charged particles, or product ionic species thereof produced from sample species, as defined in claim 1, wherein said sample is part of an incident beam of ions or charged particles, said ions or particles of unknown sample molecules of widely varying molecular weights to produce molecular ions, fragment ions, cluster ions, or other ions derived from sample components.

6. A remote reagent apparatus operated substantially below atmospheric pressure for the production of gas-phase sample ions, excited sample ions, charged particles, or product ionic species thereof produced from sample species, as defined in claim 1, wherein said sample is comprised of neutral or charged aerosol sample species such as naturally occurring or environmental aerosols, resulting from aerosol generators and sprayers, and process aerosol streams; comprised of neutral or charged gases; or combinations thereof.

7. A remote reagent apparatus operated substantially below atmospheric pressure for the production of gas-phase sample ions, excited sample ions, charged particles, or product ionic species thereof produced from sample species, as defined in claim 1, wherein said analysis of sample ions is comprised of gas-phase ion detectors such as a mass spectrometer, an ion mobility spectrometer, other low-pressure ion or particle detectors, or combinations thereof.

8. A remote reagent apparatus operated substantially below atmospheric pressure for the production of gas-phase sample ions, excited sample ions, charged particles, or product ionic species thereof produced from sample species, as defined in claim 1, wherein said reactant species comprise products of direct or alternating current electrical discharge, photoionization, electron emitting processes, sprays, sputtering or desorbing said species from surfaces, glow discharge sources, or combination thereof.

9. An remote reagent apparatus operated substantially below atmospheric pressure for the production of gas-phase sample ions, excited sample ions, charged particles, or product ionic species thereof produced from sample species, as defined in claim 1, wherein said reactant species pass through, are gated, or pulsed through said barrier by varying said voltages of said barrier, gas flowing through said barrier, or combination thereof.

10. An remote reagent apparatus operated substantially below atmospheric pressure for the production of gas-phase sample ions, excited sample ions, charged particles, or product ionic species thereof produced from sample species, as defined in claim 1, wherein said conductive barrier is geometrically sized and positioned to isolate the electric fields of said ion source from said reaction region, whereby said electric fields of said reaction region are minimal or reduced, or said reaction region is substantially field-free.

11. An remote reagent apparatus operated substantially below atmospheric pressure for the production of gas-phase sample ions, excited sample ions, charged particles, or product ionic species thereof produced from sample species, as defined in claim 1, wherein said conductive barrier has at least one opening, such as a perforated lens, a grid, a laminated structure with a least two openings, a laminated structure with a plurality of openings, or a many layer high-transmission surface with a plurality of openings; said opening(s) providing a pathway for passage of said reactant species from said ion source region to said reaction region.

12. A remote reagent apparatus operated substantially below atmospheric pressure for the production of gas-phase sample ions, excited sample ions, charged particles, or product ionic species thereof produced from sample species, as defined in claim 1, wherein said reaction region receives the outlet of said ion source by means of gas flowing from said ion source through said barrier into said reaction region.

13. A remote reagent apparatus operated substantially below atmospheric pressure for the production of gas-phase sample ions, excited sample ions, charged particles, or product ionic species thereof produced from sample species, as defined in claim 1, wherein said reaction region is further comprised of a RF multi-pole device.

14. A remote reagent apparatus operated substantially below atmospheric pressure for the production of gas-phase sample ions, excited sample ions, charged particles, or product ionic species thereof produced from sample species, as defined in claim 13, wherein said RF multi-pole device is an RF ion guide, RF ion trap, RF linear multi-pole ion trap, RF 3-dimensional multi-pole ion trap, or combinations thereof.

15. A remote reagent apparatus operated substantially below atmospheric pressure for the production of gas-phase sample ions, excited sample ions, charged particles, or product ionic species thereof produced from sample species, as defined in claim 1, further comprising a sample introduction means operated substantially at atmospheric pressure, said introduction means comprising a heated conduit for the introduction of said sample species as gaseous substances comprised of ionic, non-ionic or neutral gaseous chemical species; an aerosol comprised of neutral, ionic gas-phase species, or liquid droplets; solid, semi-solid, or liquid samples comprised of neutral or ionic species; or combinations thereof into said sample reaction region.

16. A remote reagent apparatus operated substantially below atmospheric pressure for the production of gas-phase sample ions, excited sample ions, charged particles, or product ionic species thereof produced from sample species, as defined in claim 15, wherein said sample introduction means comprises a thermospray or thermal pneumatic nebulizer for vaporizing a solution containing a solvent and molecule(s) of interest or a desorption or solids probe for vaporizing said solid, semi-solid, or liquid samples containing molecule(s) for detection or analysis.

17. A remote reagent apparatus operated substantially below atmospheric pressure for the production of gas-phase sample ions, excited sample ions, charged particles, or product ionic species thereof produced from sample species, as defined in claim 1, further comprising:

a. an exhaust outlet and pumping means for evacuating said reaction region; and b. a valve means for controlling the in-flow and out-flow of gas into and out of said reaction region;

whereby pressure within said sample reaction region is maintained substantially below atmospheric pressure.

18. A method for the production of gas-phase sample ions or product ions thereof at pressures substantially below atmospheric pressure, the method comprising:

a. generating reactant species in a remote ion source region;

b. transferring said reactant species from said remote ion source region across a perforated electrically conducting barrier to a sample reaction region; and c. reacting said reactant species in said sample reaction region with sample species to produce said gas-phase sample ions or product ions thereof, said ions comprising protonated molecules, even-electron ions, odd-electron ions, fragment ions, ion clusters, excited or metastable ions, and combination thereof;

whereby said sample ions or product ions thereof are collected or analyzed.

19. A method for the production of gas-phase sample ions or product ions thereof, as defined in claim 18, further including the steps of:

a. focusing said sample ions or product ions thereof away from said sample reaction towards a collector or analyzer by means of viscous flow of gases, electrostatic, and electro-dynamic electrical fields and combination thereof and;

b. controlling said pressure in said reaction region;

whereby said electric fields and pressure are maintained so as not to strike a gas discharge in said reaction region.

20. A method for the production of gas-phase sample ions or product ions thereof, as claimed in claim 18, further including analyzing said sample ions or product ions thereof using a low-pressure ion or particle detector.

21. A method for creating gas-phase analyte ions or product ions thereof from an analyte at pressures substantially below atmospheric pressure, the method comprising:

a. causing the production of reactant species from a reagent gas or gases;

b. transporting said reactant species to a remote reaction region through a barrier; and d. mixing said reactant species with said analyte in said reaction region so as to facilitate energy transfer from said reactant species to said analyte;

whereby said energy transfer results in the production of said analyte ions or product ions thereof, said ions comprising protonated molecules, even-electron ions, odd-electron ions, fragment ions, ion clusters, excited or metastable ions, and combination thereof.

22. A method for creating gas-phase analyte ions or product ions thereof, as defined in claim 21, where said reactant species are gas-phase ionic species and which further comprises providing an electrostatic attraction to attract or collect said analyte ions, product ions thereof and any residual ionic species in said reaction region by applying an electrostatic field generated by a high-transmission lens whereby electrostatic field lines between said reaction region and said high-transmission lens are concentrated into a plurality of openings in said high-transmission lens, thereby urging said analyte ions, product ions, and any residual said ionic species in said reaction region toward and through said openings and causing substantially all said ions in said reaction region to flow into a chamber containing an ion analyzer while avoiding striking a gas-charge in said reaction region by controlling said pressure and electrostatic fields.

23. A method for creating gas-phase analyte ions or product ions thereof, as claimed in claim 21, wherein said reactant species are produced by direct or alternating electrical current discharge of a gas, photoionization of gases, a gas discharge in a magnetic field, chemical ionization, glow discharge or sputtering or ions from surfaces, electrons emitted from the surface of a hot filament, or combinations thereof.

* * * * *